US006887529B2

(12) United States Patent
Borneman et al.

(10) Patent No.: US 6,887,529 B2
(45) Date of Patent: May 3, 2005

(54) METHOD OF APPLYING ENVIRONMENTAL AND BOND COATINGS TO TURBINE FLOWPATH PARTS

(75) Inventors: Karl Lee Borneman, Dayton, OH (US); Thomas J. Tomlinson, West Chester, OH (US); Raymond Heldorn, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 83 days.

(21) Appl. No.: 10/405,727

(22) Filed: Apr. 2, 2003

(65) Prior Publication Data

US 2004/0197486 A1 Oct. 7, 2004

(51) Int. Cl.[7] ..... C23C 4/02

(52) U.S. Cl. ..... 427/448; 427/456; 427/142; 118/503; 118/505

(58) Field of Search ..... 427/448, 456, 427/142; 29/889.1, 889.7; 118/505, 503

(56) References Cited

U.S. PATENT DOCUMENTS

| | | | | |
|---|---|---|---|---|
| 4,233,342 | A | 11/1980 | Aichert et al. | |
| 4,764,089 | A * | 8/1988 | Strangman | 415/173.4 |
| 5,112,683 | A * | 5/1992 | Johansen | 428/354 |
| 5,508,097 | A * | 4/1996 | Hauser et al. | 442/67 |
| 5,565,035 | A * | 10/1996 | Sylvestro et al. | 118/721 |
| 5,691,018 | A * | 11/1997 | Kelley et al. | 428/36.8 |
| 5,975,852 | A * | 11/1999 | Nagaraj et al. | 416/241 R |
| 6,049,978 | A | 4/2000 | Arnold | |
| 6,083,330 | A | 7/2000 | Moskowitz | |
| 6,095,755 | A * | 8/2000 | Houston | 416/241 R |
| 6,129,991 | A | 10/2000 | Warnes et al. | |
| 6,190,471 | B1 | 2/2001 | Darolia et al. | |
| 6,221,512 | B1 | 4/2001 | Rickerby | |
| 6,233,822 | B1 * | 5/2001 | Grossklaus et al. | 29/889.1 |
| 6,256,597 | B1 | 7/2001 | Wang et al. | |
| 6,358,002 | B1 | 3/2002 | Good et al. | |
| 6,383,658 | B1 * | 5/2002 | Carlson et al. | 428/615 |
| 6,403,165 | B1 | 6/2002 | Grylls et al. | |
| 6,425,745 | B1 | 7/2002 | Lavin | |
| 6,435,835 | B1 | 8/2002 | Allen et al. | |
| 6,451,454 | B1 | 9/2002 | Hasz et al. | |
| 2002/0064667 | A1 | 5/2002 | Scheckenbach et al. | |
| 2002/0090527 | A1 | 7/2002 | Thompson et al. | |
| 2002/0098294 | A1 * | 7/2002 | Lau et al. | 427/454 |
| 2002/0102360 | A1 | 8/2002 | Subramanian et al. | |
| 2003/0232139 | A1 * | 12/2003 | DeTura | 427/282 |

FOREIGN PATENT DOCUMENTS

SE 509 678 C2 * 2/1999

* cited by examiner

*Primary Examiner*—Katherine Bareford
(74) *Attorney, Agent, or Firm*—McNees Wallace & Nurick LLC

(57) ABSTRACT

A method for coating an article such as a turbine engine shroud with an environmental or bond coating, such as a MCrAlY composition, to produce a surface finish suitable for machining to predetermined dimensions and specifications. The method of applying an environmental or bond coating uses a thermal spray process such as hyper velocity oxygen fuel ("HVOF") to produce a thick and reasonably uniform coating which can be machined to desired dimensions while still providing key quality characteristics required to protect the coated parts in a high temperature, oxidative and corrosive atmosphere and permitting application of long life thermal barrier topcoats.

20 Claims, 7 Drawing Sheets

METHOD OF APPLYING ENVIRONMENTAL AND BOND COATINGS TO TURBINE FLOWPATH PARTS

BACKGROUND OF THE INVENTION

This invention is directed to a method of applying an environmental or bond coating applied to turbine engine assemblies and parts, such as airfoils and shrouds, using a thermal spray process, and specifically to a method of applying MCrAlY and other HVOF-applied coatings having key quality characteristics required to protect the coated parts in a high temperature, oxidative and corrosive atmosphere while permitting application of long life thermal barrier topcoats.

Many systems and improvements to turbine coatings have been set forth in the prior art for providing protection to turbine airfoils and shrouds in and near the flowpath (hot section) of a gas turbine from the combined effects of high temperatures, an oxidizing environment and hot corrosive gases. These improvements include new formulations for the materials used in the airfoils and include exotic and expensive nickel-based superalloys. Other solutions have included application of coating systems, including environmental coating systems and thermal barrier coating systems. The environmental coating systems include nickel aluminides, platinum aluminides and combinations thereof. Known processes and methods of applying the include thermal spray techniques including but not limited to low pressure plasma spray (LPPS), hyper velocity oxy-fuel (HVOF) and detonation gun (D-gun), all of which thermally spray a powder of a predetermined composition.

A multitude of improvements in such coatings and in methods of applying such coatings has been set forth that increase the life of the system, and developments in these improvements continue. In certain systems, thermal barrier coatings (TBC's) in the form of a ceramic are applied over the environmental coatings. In other systems, a bond coat such as a MCrAlYX, where M is an element selected from Ni, Go, Fe or combinations of these elements, and where X is a trace metal such as Ce, Pr, Nd, Pm, Sm, Eu, Gd, Tb, Dy, Ho, Er, Tm, Yb, Lu, and Y, is applied as an intermediary between the airfoil and the applied ceramic. The bond coat is also to improve the environmental performance of the system. The coatings which include aluminides and MCrAlX alloys can be non-brittle or brittle, depending upon whether they are comprised substantially of gamma or gamma+gamma prime phases.

Despite the many improvements in the field of applied environmental coatings, a continuing problem is that known coating methods do not provide a sufficiently thick and uniform coating on part edges, especially on acute edges such as on high pressure turbine shrouds ("HPT shrouds") and low pressure turbine shrouds ("LPT" shrouds) and similar parts in the turbine flowpath. Application of the coating to such flowpath parts is frequently accomplished using a Hyper-Velocity OxyFuel ("HVOF") thermal spray process, which is often robotically controlled. However, using known tooling and methods, the HVOF process tends to leave a thinner coating on the fore and aft edges of parts such as shrouds, and the coating tends to round out on the edges as it is applied. Such rounding leaves an insufficiently thick coating for proper machining of edges to the desired shape, and can result in an exposed edge, or in insufficient coating to protect the underlying edge during turbine operation.

What is needed are cost effective methods that can be employed to ensure that edges and other flowpath surfaces of blades, shrouds, and other flowpath parts are sufficiently coated so as to permit subsequent machining to provide the desired edge shape, while still providing adequate coating thickness to protect the underlying part.

SUMMARY OF THE INVENTION

The techniques of the present invention represent novel improvements in applying coatings using thermal spray processes, especially HVOF, to achieve sufficient thickness on flowpath part edges to allow for subsequent machining. While the present invention was developed for use with MOrAlY and NiAl coatings applied by HVOF methods, it may be used advantageously with any other coating deposited by thermal spraying process. Preferably. the initial base coating is a MCrAlX composition. wherein M is Ni. the composition having Al in atomic percent of about 37% to about 73%, and the balance comprised of a combination of Ni. Cr and incidental impurities and X is at least one substitutional element selected from the group consisting of Ce, Pr, Nd, Pm, Sm, Eu, Gd, Tb, Dv, Ho, Er, Tm, Yb, Lu, and Y.

An advantage of the present invention is the ability to tailor the coating thickness. In particular, the present invention provides the ability to increase the thickness of such a coating on part edges without compromising density or integrity of the coating or otherwise damaging it during subsequent machining operations. Thus, the present invention can provide the desired coating thickness to allow machining, while still providing the improved corrosion and oxidation capabilities in the finished part. Airfoils, shrouds, and other flowpath parts that have had their surfaces coated in accordance with the present invention can be machined to dimensions and specifications necessary to produce a more aerodynamic gas flow path that serves to improve efficiency, yet will still have sufficient coating thickness to provide the desired thermal and corrosion protection.

Still another advantage of the methods of the present invention is that they can be applied to both new shrouds and to shrouds that have undergone or are undergoing repair. These methods provide a simple, effective technique for achieving thick NiAl and other MCrAlY coatings by HVOF processes that are reasonably easy to reproduce, predictable, and cost effective.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides methods and apparatus for coating of flowpath parts, and particularly for applying a thick coating on part edges using novel thermal spray methods and apparatus, and modifying the applied coating by machining to predetermined dimensions and specifications. With reference to the drawings.

Wherever possible, the same reference numbers will be used throughout the drawings to refer to the same or like parts.

DETAILED DESCRIPTION OF THE INVENTION

Figure 1:
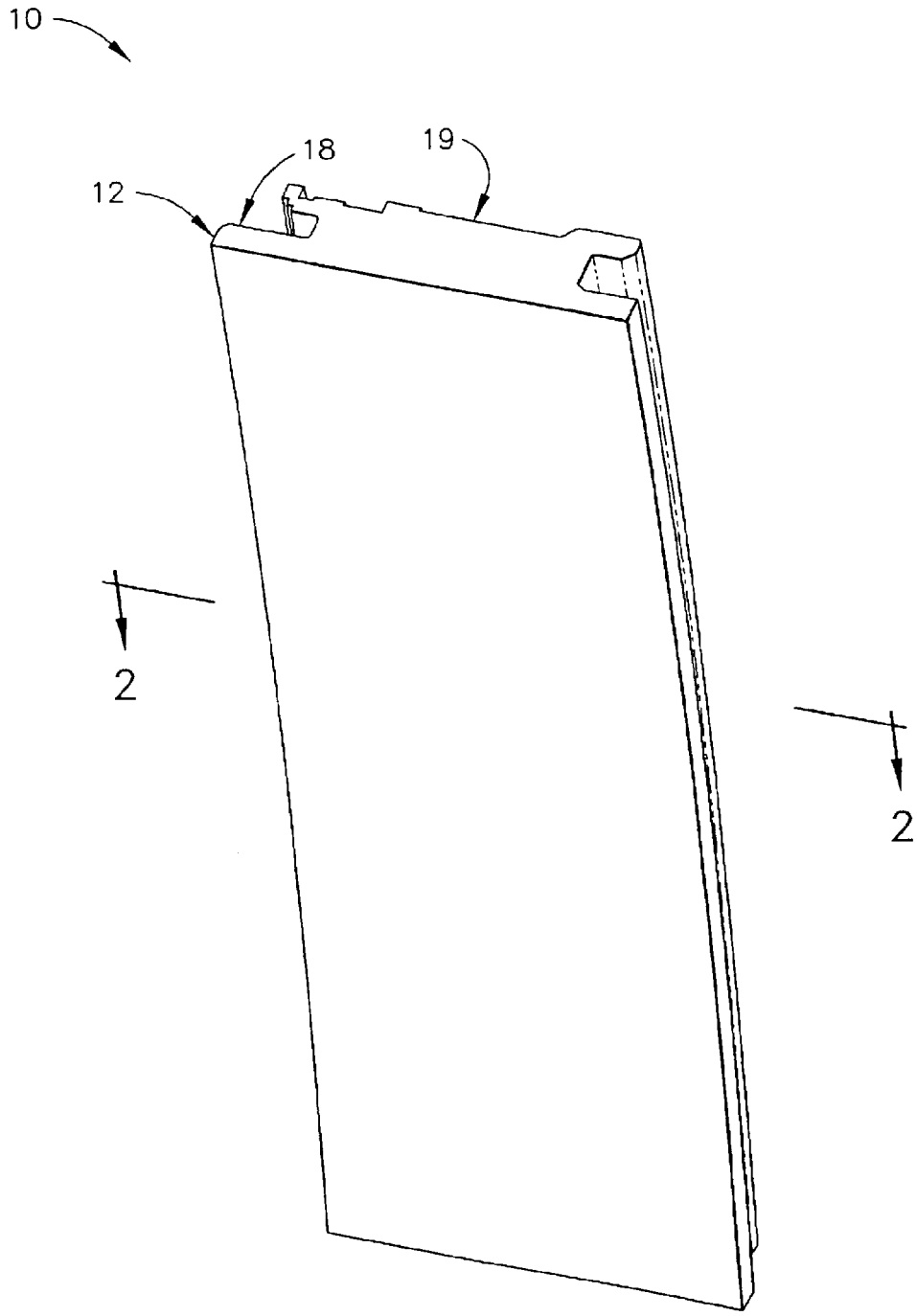
FIG. 1 is a side perspective view of a typical shroud from a gas turbine engine assembly.
Figure 2:
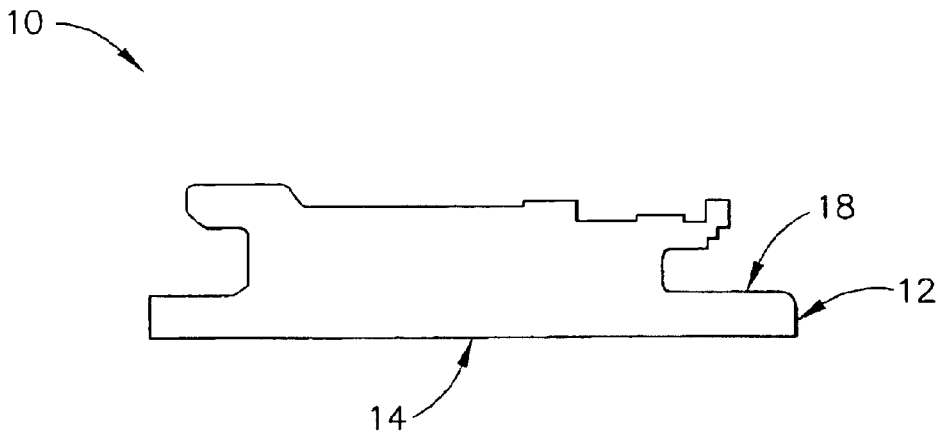
FIG. 2 is a cross sectional top view of an uncoated shroud of FIG. 1 along the line II—II.
Figure 3:
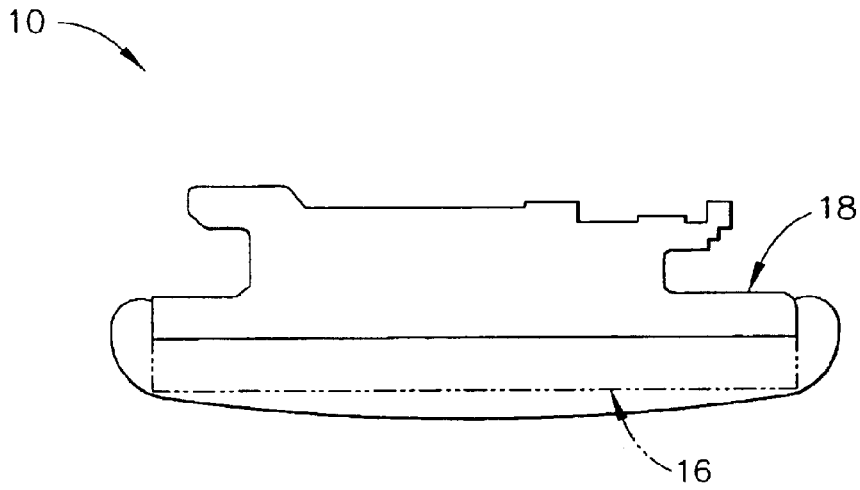
FIG. 3 is a cross sectional top view of a shroud after coating using the methods of the present invention.
Figure 4:
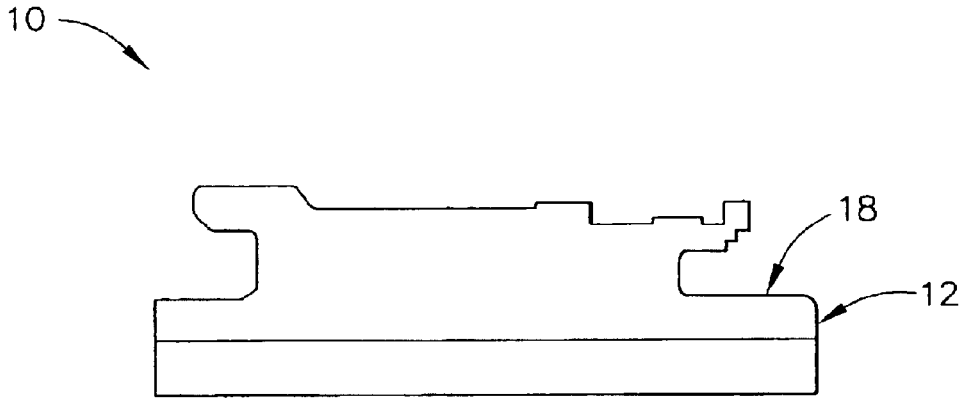
FIG. 4 is a cross sectional top view of the coated shroud of FIG. 2 after machining in accordance with the present invention to restore the desired dimension and shape of the shroud cross section.

The methods of the present invention can be used to coat new or used flowpath parts of gas turbine engine assemblies. The methods are particularly suited to HPT and LPT shrouds, such as those illustrated in FIG. 1 and FIG. 2, where MCrAlY coatings must be applied to form a thick layer, preferably greater than 0.100 inches thick. Such thick coatings may be accomplished using HVOF thermal spray apparatus in accordance with the methods of the present invention. As shown in FIG. 3, the desired result using the spraying methods of the present invention is to produce a coated part, such as a shroud 10 with a reasonably uniform final coating having a thickness of preferably between about 0.100 to about 0.110 inch on the side edges 12 and flowpath face 14 of the part so that subsequent machining of the coating can be performed to yield a uniformly thick coating having the desired cross-sectional shape shown by the dotted line 16 of FIG. 3 and FIG. 4 following machining to a produce a part having a predetermined shape and dimension. In the preferred embodiment of FIG. 3, the post-machined coating is uniformly about 0.080 inch thick.

Figure 5:
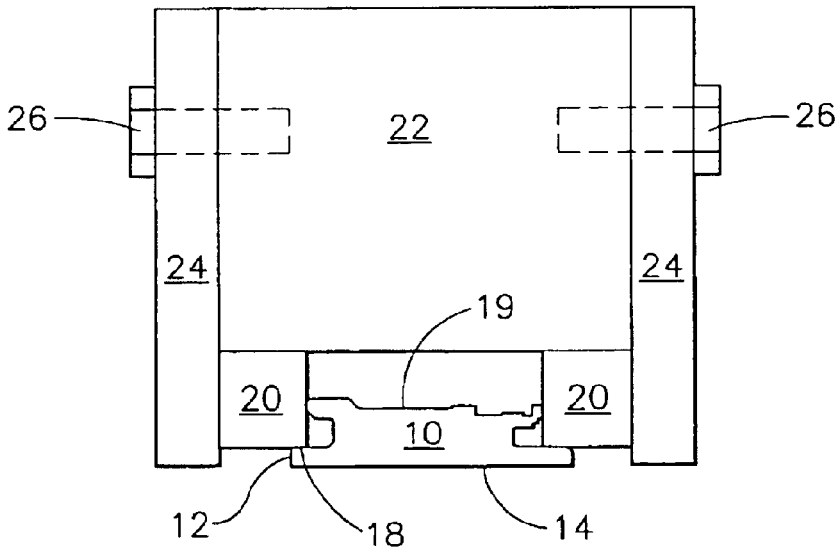
FIG. 5 is a top cross-sectional view of a shroud mounted on a mounting block with the backing of the present invention applied to the rear edge of the shroud to provide a corner to trap coating necessary to build a base coating on the shroud side edges and flowpath face.

As previously described, the challenge of spraying thick coatings onto shrouds and other flowpath parts is that the coating tends to be thinner at part edges, and tends to round out around the edges. The methods of the present invention remedy this problem by utilizing spraying methods and apparatus which allow build-up of a thick coating at part edges. The methods involve the novel use of a backing apparatus positioned against the back edge or edges of the part to be coated. As shown in FIG. 5, the backing 20 is placed against the rear edges 18 of the shroud 10 in a manner which forms a corner between the side edge 12 of the shroud 10 and the backing 20. In the preferred embodiment shown in FIG. 5, the backing 20 is thick enough so that it contacts the rear edge 18 and is partially compressed as the shroud 10 is mounted onto the mounting block 22 which serves as a part holding apparatus during spraying operations. Most preferably, the backing 20 is also wide enough so that it extends slightly beyond the edge of the block 22 so that side plates 24, through tightening means such as screws 26 or the equivalent, may also be used to compress the backing against the body 19 of the shroud 10, thus effectively sealing the backing 20 against the rear edge 18 of the shroud 10 to ensure that only the side edges 12 and flowpath face 14 are sprayed during coating operations. Using this configuration, the backing 20 and side edge 12 form a corner which traps the coating to allow it to adhere sufficiently to the side edge 12 to build the desired coating base, and also to subsequently uniformly coat the entire side edges 12 and flowpath face 14.

The novel backing 20 of the invention possesses non-adherent properties with respect to the coating. Preferably, the backing material is a semi-flexible, non-adherant, non-metallic material such as rubber, plastic, TEFLON®, or the like. TEFLON is a registered trademark of the E. I. DU PONT DE NEMOURS AND COMPANY CORPORATION DELAWARE 1007 MARKET STREET WILMINGTON Del. 19898 for polytetrafluoroethylene coatings (USPTO Reg. 0559331) and synthetic resinous fluorine-containing (i.e. polytetrafluoroethylene) polymers in the form of molding and extruding compositions (USPTO Reg. 0418698). More preferably, the backing material is silicone rubber having a hardness of between 60 and 110 Shore A durometer. Most preferably, the backing material is silicon rubber having a hardness of between 80 and 100 Shore A durometer.

Figure 6:
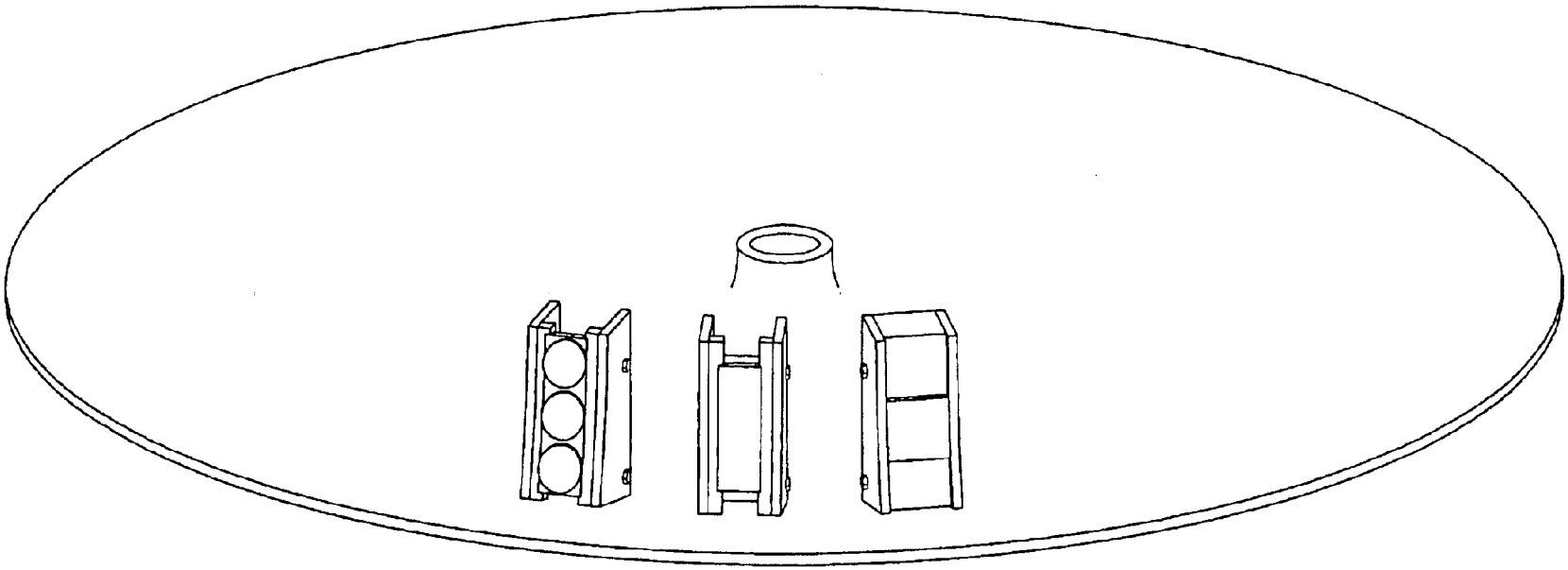
FIG. 6 illustrates a series of three mounting blocks attached to a turntable and having various parts mounted for rotational spraying in accordance with the present invention.
Figure 7:
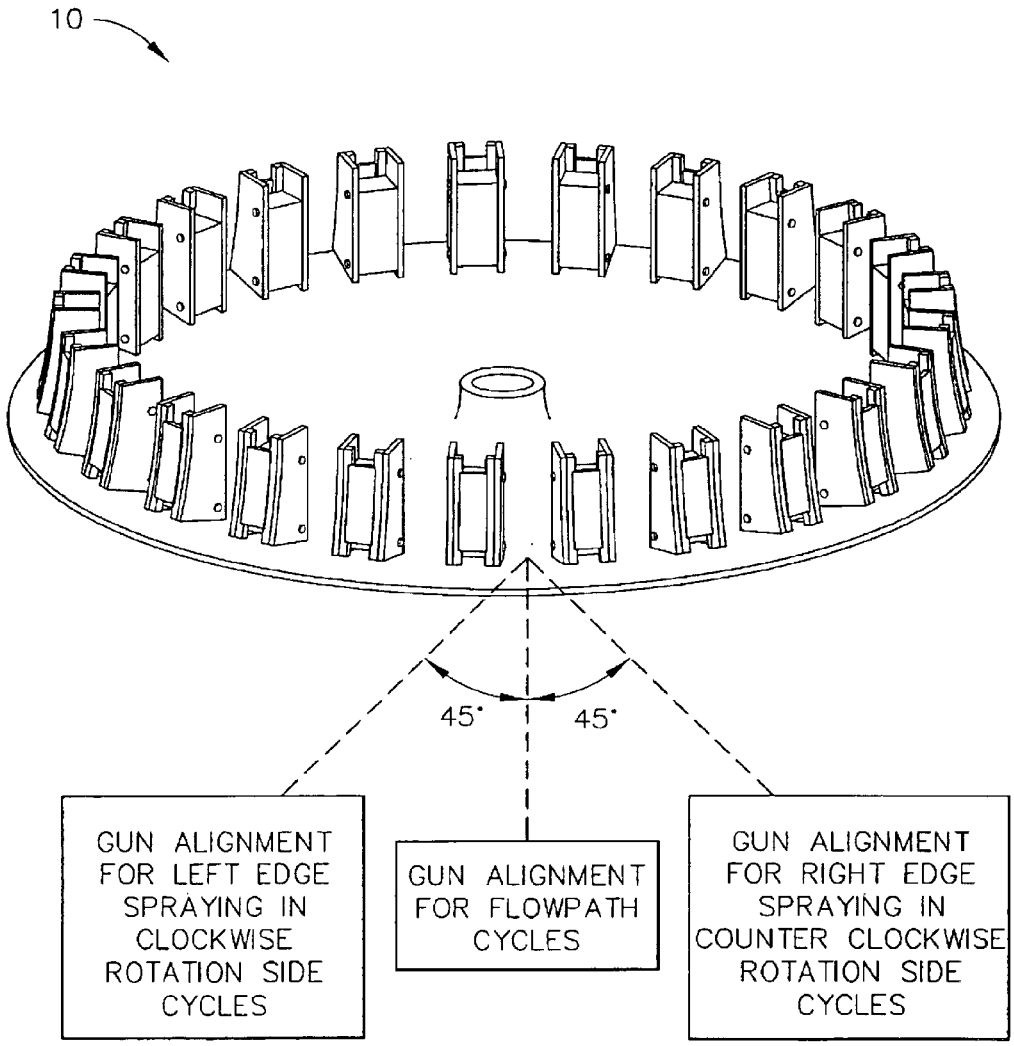
FIG. 7 illustrates the turntable of FIG. 6 with a full complement of mounting blocks installed, as well as the alignments for the HVOF spray gun for spraying of the side edges and the flowpath face in accordance with the present invention.

In one embodiment of the spraying methods of the present invention, the backing 20 is positioned against the rear edge 18 of the shroud 10 as shown in FIG. 5. Preferably, to maximize the ability to spray all desired flowpath surfaces, the shroud is mounted on a holding apparatus after turning the part 90 degrees from its circumferential engine position, and preferably also rotating the part 180 degrees around its longitudinal axis so that the flowpath face 14 (which is on the inner diameter of the shroud, facing the engine) is facing outward when mounted on the holding apparatus. Preferably, the holding apparatus is a turntable similar to that shown in FIGS. 6 and 7, and includes mounting means such as a plurality of fingers or blocks 22, as shown in FIGS. 5–7, each of which can hold a shroud 10 in the desired orientation during spraying operations. In any event, the holding apparatus must be able to seat the backing 20 completely against the rear edge 18 of the part to be coated, leaving no gaps which would allow coating material to spray to the shroud body 19, dovetail features, or other protected areas of the shroud 10. Protected areas of the shroud 10 and non-mounting areas of the block 22 and other parts of the holding apparatus may also taped to prevent damage and over-spray of coating.

Figure 8:
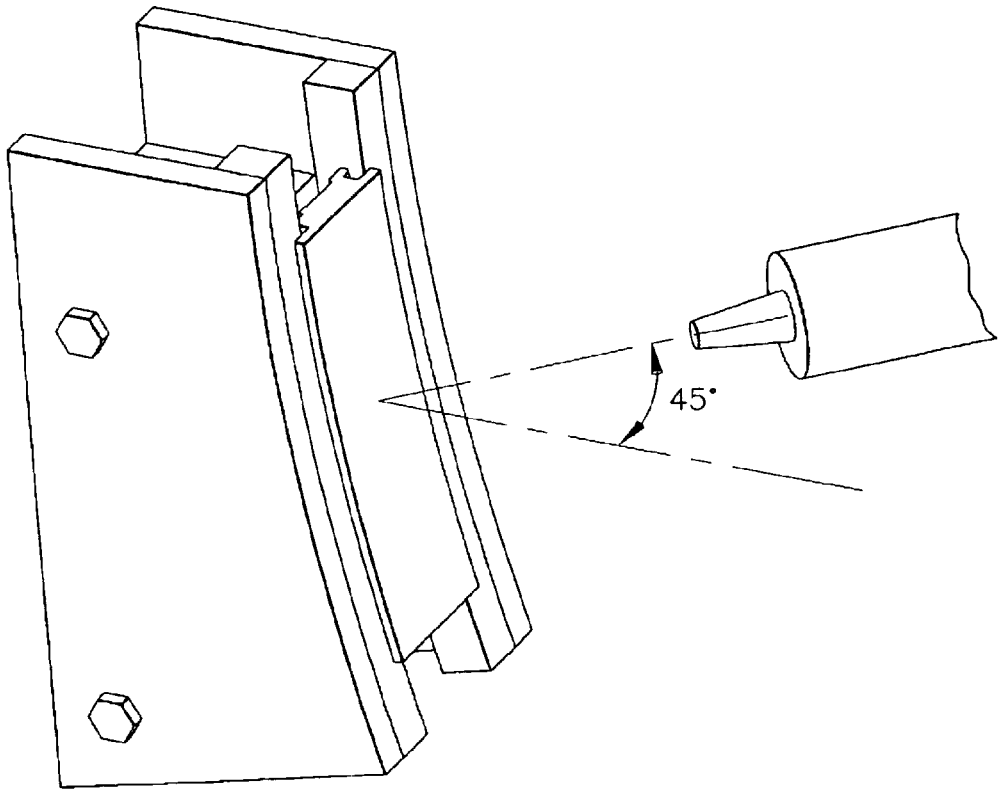
FIG. 8 illustrates the alignment of an HVOF spray gun at about 45° angle from the flowpath face for left edge spraying in accordance with the present invention.

In the preferred embodiment, the spraying method involves use of rotational processes wherein the holding apparatus includes a turntable such as that shown in FIGS. 5–8, which can be rotated at predetermined speeds, and wherein the HVOF apparatus is programmable robotic manipulation of a HVOF spray gun which delivers coating at a calculated rate. An exemplary HVOF spray gun is the Stellite JetKote 3000 having a 12 inch nozzle length and a 0.25 inch nozzle bore, although other models and types of thermal spray guns may be adapted to practice the invention by those skilled in the art with a reasonable amount of experimentation. Preferably, the rotational spraying is not indexed, but is continuous so as to build a more even coating layer as the turntable rotates each shroud past the spray gun. In this embodiment, the spray operation sequence is to spray each of the shroud's side edges 12, changing the turntable rotation direction as necessary until about from between about 0.01 to about 0.020 inch of coating is built up on each side edge 12. This may take as many as fifty cycles, depending upon turntable speed, application rate and other known coating parameters. As shown in FIGS. 7 and 8 the spraying to build up the side edges 12 involves positioning the HVOF apparatus so that spray is preferably delivered at about an angle of 45 degrees relative the flowpath face 14 of the shroud 10. In a more preferred embodiment, the spray is applied at an angle of 45 degrees relative to the flowpath face 14 of the shroud 10. After the side edges 12 are built up with a base coating, the entire flowpath surface 14 of the shroud 10 is coated to the desired thickness, preferably using a rotational spray process.

Figure 9:
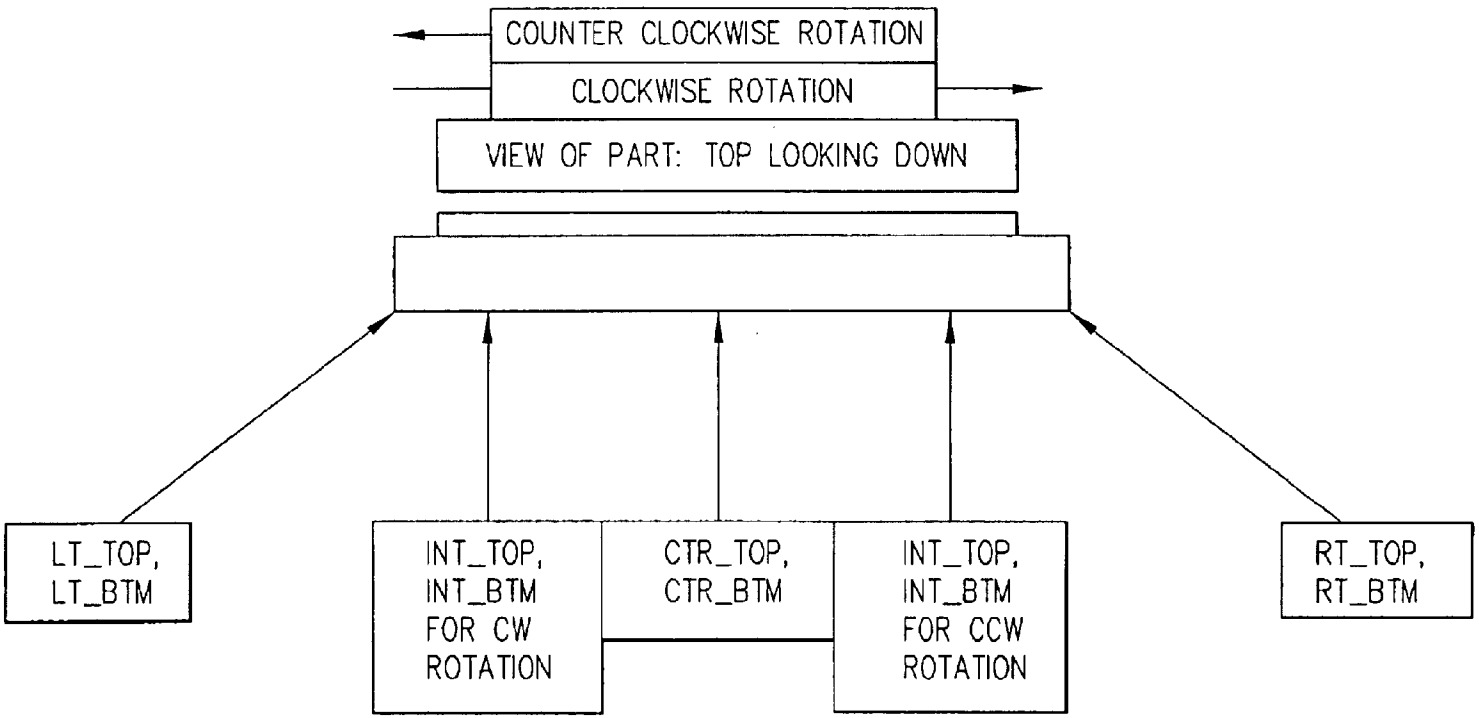
FIG. 9 is a diagram of the preferred spray cycle methods of the present invention.

In the preferred embodiment, as illustrated in FIGS. 7–9, the rotational spraying method is made up of cycles. To build the base coating, the cycle utilizes a series of repeating side cycles which involve varying the direction of turntable rotation and the position of the spray gun vertically to apply an even coating to each side edge. Preferably, as illustrated in FIGS. 7–8, the vertical movement of the spray gun during counter clockwise turntable rotations is from right top to right bottom and back to right top. More preferably, the vertical movement of the gun is arced to mimic the shape of the part being sprayed or is otherwise manipulated so that that the gun remains at a predetermined distance from the surface being sprayed throughout the entire cycle. For clockwise turntable rotations, the gun moves vertically from left top to left bottom and back to left top. In this preferred embodiment, approximately fifty such side cycles are required to build a base coating about 0.020 in. thick. Preferably, the fifty side cycles are executed in the following sequence: ten side cycles with turntable rotating clockwise; ten side cycles with the turntable rotating counterclockwise; fifteen side cycles with the turntable rotating clockwise; and fifteen side cycles with the turntable rotating counterclockwise. However, additional side cycles may be utilized as necessary to build the desired side coating thickness Next, the final coating is built on the flowpath face 14 by executing a series of repeating flowpath face cycles which involve varying direction of turntable rotation while moving the spray gun vertically, preferably from top to bottom and back to the top. Preferably, the spray gun is placed approximately perpendicular to the flowpath face for flowpath cycles. As shown in FIG. 9, the position of the spray gun at the top and bottom is determined relative to the calculated center of each shroud, and is varied depending on the direction of turntable rotation. As shown in FIG. 7, for flowpath face cycles in which the turntable is rotated clockwise, the gun is taught to spray to a predetermined offset to the right, with the offset determined based upon the width of the flowpath face 14 so that the spray overlaps the base coating and preferably reaches the intersection with the right side edge to allow buildup and also to clear debris. As shown in FIGS. 7–8, for flowpath face cycles in which the turntable is rotated counterclockwise, the gun is taught to spray to a predetermined offset to the left, with the offset determined based upon the width of the flowpath face 14 so that the spray overlaps the base coating and preferably reaches the intersection with the left side edge to allow buildup and also to clear debris. Preferably, the final coating is about 0.100 in. thick, and is built by executing a series of about 200 flowpath face cycles. In this preferred embodiment, the about 200 flowpath face cycles are executed in the following sequence with turntable rotation as specified: fifty cycles with turntable rotating clockwise; fifty cycles with the turntable rotating counterclockwise; fifty cycles with the turntable rotating clockwise; and fifty cycles with the turntable rotating counterclockwise. Optionally, after flowpath face cycles are completed, additional side cycles may be executed to build a thicker coating on the side edges 12. Additional flowpath cycles may also be added to obtain the desired final coating thickness.

To verify the coating thickness during base coating and final coating, known test processes such as the use of tensile buttons may be utilized, and thickness can also be verified by comparison with a thickness panel, as shown in FIG. 6. Preferably, where a turntable is used in a rotational process, the tensile buttons may be provided on blank or unoccupied mounting blocks 22 and rotated through the spray path to accumulate coating at the same rate as the shrouds 10.

In another embodiment, the methods of the present invention involve preparation of the shroud prior to coating. The purpose of preparation is to provide a clean, non-contaminated surface for coating. In the preferred embodiment, preparation includes taping of parts for grit blasting of the flowpath face 14 and side edges 12. Preferably, grit blasting is performed using 60–80 mesh $Al_2O_3$ to achieve a surface of about between 80–150 Ra. A water jet is next preferably used to smooth and clean the surface, and after a water jet cleaning, the treated part surfaces are considered non-contaminated. These surfaces must be kept clean of oils, dirt, etc, and any handling of parts should be not involve touching with hands. Next, the part is placed in a holding apparatus and coated, preferably using the rotational spray methods previously described.

Optionally, after coating, the shrouds may be heat treated using methods known to those skilled in the art. Preferably, the heat treatment is based on the metallography, and is about 2050° F. (+/−25° F.) for about 4 hrs. min., and is performed in vacuum, preferably of 1 micron or less. Also, the coated parts may be machined to restore the desired flowpath shape and dimensions. Machining should remove only enough coating to restore the desired shape without damaging the coating or leaving any exposed flowpath part surface. Preferably, machining results in a reasonably uniform coating thickness of about between 0.040 and 0.010 inch. More preferably, the final coating thickness is about 0.060 to 0.090 inch. Most preferably, the final coating thickness is about 0.070 to 0.080 inch.

While the present invention has been described in terms of primarily a MCrAlY coating applied by HVOF processes to shrouds to form an environmental or bond coating, it will be understood that the invention can be used for any coating which can be applied by HVOF. The methods can also be applied to utilize other thermal spray coating and thermal spray processes without departing from the scope of the contemplated invention. This may permit the use of coatings that previously may not have been considered because of the inability to obtain a sufficiently thick edge to allow for subsequent machining.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for applying a thermal spray coating to a flowpath part of a gas turbine engine, the method comprised of the steps of:

providing a flowpath part of a gas turbine engine having a flowpath face, at least one side edge, and at least one rear edge;

inserting the flowpath part into a holding apparatus, the holding apparatus comprising a turntable having at least one mounting block mounted thereon, the at least one mounting block including at least one side plate for adjustably holding the flowpath part in a desired orientation, the at least one mounting block further including tightening means for adjusting the position of the at least one side plate;

placing a backing in substantial contact with the rear edge of the flowpath part, the backing further in contact with the mounting block;

operating the tightening means to compress the backing to seal the backing to the rear edge of the flowpath part while leaving the at least one side edge exposed; and applying an initial base coating to the at least one side edge by thermal spraying.

2. The method of claim 1, wherein the initial base coating is between about 0.010 to about 0.020 inches thick.

3. The method of claim 1, further comprised of the step of applying at least one additional base coating over the initial base coating to form a substantially uniform coating on the side edges and flowpath face.

4. The method of claim 3, wherein the substantially uniform coating is at least about 0.10 inch thick.

5. The method of claim 4, further comprising the step of machining the substantially uniform coating to a predetermined dimension without damaging the coating.

6. The method of claim 5, wherein the predetermined dimension comprises a substantially uniform coating having a thickness of from about 0.060 to about 0.080 inch.

7. The method of claim 1 wherein the flowpath part is a low pressure turbine shroud or a high pressure turbine shroud.

8. The method of claim 1 wherein the initial base coating is applied using HVOF.

9. The method of claim 8, wherein the initial base coating is applied at an angle of about 45 degrees relative to the flowpath face.

10. The method of claim 9, wherein the initial base coating is a MCrAlX composition, wherein M is Ni, Co, Fe, or combinations thereof, and wherein is at least one substitutional elements selected from the group consisting of Ce, Pr, Nd, Pm, Sm, Eu, Gd, Th, Dy, Ho, Er, Tm, Yb, Lu, and Y or the initial base coating is NiAl.

11. The method of claim 10 wherein the initial base coating is a MCrAlX composition, wherein M is Ni, the composition having Al in atomic percent of about 37% to about 73%, and the balance comprised of a combination of Ni, Cr, X and incidental impurities, wherein X is at least one substitutional elements selected from the group consisting of Ce, Pr, Nd, Pm, Sm, Eu, Gd, Tb, Dy, Ho, Er, Tm, Yb, Lu, and Y.

12. The method of claim 1 wherein the backing is flexible and possesses non-adherent properties with respect to the coating.

13. The method of claim 12 wherein the backing is selected from the group consisting of rubber, plastic, and polytetrafluoroethylene, and synthetic resinous fluorine-containing polymers.

14. The method of claim 13, wherein the backing is silicone rubber.

15. The method of claim 14, wherein the backing is silicone rubber having a hardness of about between 60–110 Shore A durometer.

16. The method of claim 15 wherein the backing is silicone rubber having a hardness of about between 80–100 Shore A durometer.

17. The method of claim 16 wherein the flowpath part is a used part which requires coating repair.

18. The method of claim 16, wherein the flowpath part is new and previously uncoated.

19. The method of claim 16, wherein the flowpath part is used and previously coated.

20. The method of claim 13, wherein the backing possesses non-adherent properties with respect to the flowpath part and the mounting means.

* * * * *

UNITED STATES PATENT AND TRADEMARK OFFICE

CERTIFICATE OF CORRECTION

PATENT NO. : 6,887,529 B2
DATED : May 3, 2005
INVENTOR(S) : Borneman et al.

It is certified that error appears in the above-identified patent and that said Letters Patent is hereby corrected as shown below:

Column 6,
Line 32, "4 hrs. min., and" should be -- 4. hrs., and --.

Column 8,
Line 6, "wherein is" should be -- wherein X is --.

Signed and Sealed this

Twenty-first Day of February, 2006

JON W. DUDAS
*Director of the United States Patent and Trademark Office*